US011970819B2

(12) United States Patent
Lindsay et al.

(10) Patent No.: US 11,970,819 B2
(45) Date of Patent: Apr. 30, 2024

(54) TISSUE PRODUCTS COMPRISING CROSSLINKED FIBERS

(71) Applicant: Kimberly-Clark Worldwide, Inc., Neenah, WI (US)

(72) Inventors: Stephen M. Lindsay, Appleton, WI (US); Richmond R. Cohen, Appleton, WI (US); Kenneth R. Schueler, Jr., Appleton, WI (US); Kenneth J. Zwick, Madison, WI (US)

( * ) Notice: Subject to any disclaimer, the term of this patent is extended or adjusted under 35 U.S.C. 154(b) by 158 days.

(21) Appl. No.: 17/796,713

(22) PCT Filed: Jan. 20, 2021

(86) PCT No.: PCT/US2021/014147
§ 371 (c)(1),
(2) Date: Aug. 1, 2022

(87) PCT Pub. No.: WO2021/154560
PCT Pub. Date: Aug. 5, 2021

(65) Prior Publication Data

US 2023/0072598 A1 Mar. 9, 2023

Related U.S. Application Data

(60) Provisional application No. 62/967,902, filed on Jan. 30, 2020.

(51) Int. Cl.

| | |
|---|---|
| ***D21H 11/20*** | (2006.01) |
| ***D21C 9/00*** | (2006.01) |
| ***D21F 11/04*** | (2006.01) |
| ***D21H 11/04*** | (2006.01) |
| ***D21H 27/00*** | (2006.01) |
| ***D21H 27/38*** | (2006.01) |
| ***D21H 27/40*** | (2006.01) |

(52) U.S. Cl.
CPC ..... *D21H 11/20* (2013.01); *D21C 9/005* (2013.01); *D21F 11/04* (2013.01); *D21H 27/005* (2013.01); *D21H 27/38* (2013.01); *D21H 27/40* (2013.01)

(58) Field of Classification Search
CPC ..... D21H 11/20; D21H 27/005; D21H 27/38; D21H 27/40; D21H 27/002; D21H 11/16; D21H 27/14; D21F 11/04; D21F 11/14; D21C 9/005
See application file for complete search history.

(56) References Cited

U.S. PATENT DOCUMENTS

| | | | | |
|---|---|---|---|---|
| 3,455,778 | A | 7/1969 | Bernardin | |
| 3,657,066 | A | 4/1972 | Chene et al. | |
| 3,817,825 | A | 6/1974 | Maranville et al. | |
| 3,880,707 | A | 4/1975 | Pattison | |
| 3,880,709 | A | 4/1975 | Pattison | |
| 3,932,209 | A | 1/1976 | Chatterjee | |
| 3,988,198 | A | 10/1976 | Wilson et al. | |
| 4,162,359 | A | 7/1979 | Leithem et al. | |
| 4,181,567 | A | 1/1980 | Riddell et al. | |
| 4,399,275 | A | 8/1983 | Sears | |
| 4,416,727 | A | 11/1983 | Elton et al. | |
| 4,583,984 | A | 4/1986 | Turunen et al. | |
| 4,889,595 | A | 12/1989 | Herron et al. | |
| 5,087,324 | A * | 2/1992 | Awofeso | D21H 11/04 162/149 |
| 5,225,047 | A | 7/1993 | Graef et al. | |
| 5,549,791 | A * | 8/1996 | Herron | D21C 9/005 162/158 |
| 5,755,828 | A | 5/1998 | Westland | |
| 6,350,349 | B1 | 2/2002 | Hermans et al. | |
| 6,361,651 | B1 | 3/2002 | Sun | |
| 6,419,787 | B2 | 7/2002 | Goulet et al. | |
| 6,531,593 | B1 | 3/2003 | Luo et al. | |
| 6,620,293 | B2 | 9/2003 | Sears et al. | |
| 6,805,772 | B2 * | 10/2004 | Schwarz | D21G 9/0009 162/DIG. 11 |
| 6,837,972 | B2 * | 1/2005 | Marsh | B32B 29/00 162/146 |
| 6,843,852 | B2 | 1/2005 | Dubin et al. | |
| 6,949,166 | B2 * | 9/2005 | Bakken | D21F 11/14 162/123 |
| 7,195,695 | B2 | 3/2007 | Sears et al. | |
| 7,288,167 | B2 | 10/2007 | Sears et al. | |
| 7,291,247 | B2 * | 11/2007 | Lee | D21C 9/163 428/221 |

(Continued)

FOREIGN PATENT DOCUMENTS

| | | | | |
|---|---|---|---|---|
| CN | 1071823 C * | 9/2001 | | A61L 15/24 |
| EP | 0008536 B1 | 8/1984 | | |

(Continued)

OTHER PUBLICATIONS

Diack, A., Solenis: World-class Wet Strength Resins for Tissue and Towel. Perini Journal, Sep. 30, 2014, vol. 43.

*Primary Examiner* — Jose A Fortuna

(74) *Attorney, Agent, or Firm* — KIMBERLY-CLARK WORLDWIDE, INC.

(57) ABSTRACT

The present disclosure relates to tissue products comprising crosslinked fibers. The tissue products generally have good formation, such as a Formation Index greater than about 20, strength, such as geometric mean tensile strengths greater than about 700 g/3" and high bulk, such as sheet bulks greater than about 10 cc/g. Unlike many prior art crosslinked fibers, the crosslinked softwood pulps of the present invention, which are preferably prepared using a glyoxal based crosslinking reagent, are readily dispersible in water and have relatively low degrees of kink and curl. As such, the fibers are well suited for forming wet-laid tissue products and more particularly wet-laid tissue products having improved physical properties, such as improved bulk.

19 Claims, 1 Drawing Sheet

(56) References Cited

U.S. PATENT DOCUMENTS

| | | | | |
|---|---|---|---|---|
| 7,320,740 | B2 | 1/2008 | Hamed et al. | |
| 7,812,153 | B2 | 10/2010 | Svenson et al. | |
| 8,247,641 | B2 | 8/2012 | Leithem et al. | |
| 8,277,606 | B2 * | 10/2012 | Lee | D21H 11/16 162/13 |
| 8,500,956 | B2 | 8/2013 | Sixta et al. | |
| 8,734,612 | B2 | 5/2014 | Leite | |
| 9,771,687 | B2 * | 9/2017 | Luo | D21H 13/04 |
| 9,926,665 | B2 * | 3/2018 | Luo | D21H 11/14 |
| 10,415,189 | B2 * | 9/2019 | Hamed | D21C 9/005 |
| 10,428,459 | B2 * | 10/2019 | Luo | D21H 11/14 |
| 10,458,067 | B2 * | 10/2019 | Zawadzki | D06M 15/59 |
| 10,829,892 | B2 * | 11/2020 | Luo | D21H 13/04 |
| 11,466,409 | B2 * | 10/2022 | Tirimacco | D21H 25/14 |
| 11,795,619 | B2 * | 10/2023 | Wei | D21H 27/02 |
| 2003/0070776 | A1 | 4/2003 | Crow et al. | |
| 2003/0201083 | A1 * | 10/2003 | Marsh | D21H 27/30 162/146 |
| 2003/0203195 | A1 | 10/2003 | Marsh | |
| 2004/0177935 | A1 | 9/2004 | Hamed et al. | |
| 2004/0256065 | A1 | 12/2004 | Ahmed et al. | |
| 2005/0072542 | A1 | 4/2005 | Sears et al. | |
| 2005/0145348 | A1 * | 7/2005 | Lee | D21C 9/007 162/111 |
| 2006/0144541 | A1 | 7/2006 | Joy Nickel et al. | |
| 2007/0254550 | A1 | 11/2007 | Hamed et al. | |
| 2010/0021975 | A1 | 1/2010 | Sixta et al. | |
| 2010/0212849 | A1 | 8/2010 | Smith et al. | |
| 2013/0029106 | A1 | 1/2013 | Lee et al. | |
| 2013/0149614 | A1 | 6/2013 | Kubo et al. | |
| 2014/0105691 | A1 | 4/2014 | Friederichs et al. | |
| 2015/0041087 | A1 | 2/2015 | Hawkins et al. | |
| 2015/0259859 | A1 | 9/2015 | Ringold et al. | |
| 2015/0376347 | A1 * | 12/2015 | Miller | D21C 9/00 536/63 |
| 2018/0313038 | A1 * | 11/2018 | Bradbury | D21H 21/22 |
| 2018/0363245 | A1 * | 12/2018 | Luo | D21C 9/005 |
| 2019/0136457 | A1 * | 5/2019 | Lindsay | D21H 27/00 |
| 2019/0226147 | A1 * | 7/2019 | Zawadzki | D21H 11/20 |
| 2019/0309482 | A1 | 10/2019 | Zawadzki et al. | |
| 2021/0054572 | A1 * | 2/2021 | Zawadzki | D21H 21/20 |
| 2021/0087751 | A1 * | 3/2021 | Bradbury | D21H 23/04 |
| 2021/0238808 | A1 * | 8/2021 | Tirimacco | D21H 27/38 |
| 2022/0090328 | A1 * | 3/2022 | Lilley | D21H 27/34 |
| 2023/0072598 | A1 * | 3/2023 | Lindsay | D21H 27/40 |

FOREIGN PATENT DOCUMENTS

| | | | |
|---|---|---|---|
| EP | 0251674 | A2 | 1/1988 |
| EP | 0252649 | A2 | 1/1988 |
| EP | 0700473 | A1 | 3/1996 |
| WO | 1995009273 | A1 | 4/1995 |
| WO | 1997043483 | A1 | 11/1997 |
| WO | 1998013545 | A1 | 4/1998 |
| WO | 1998027262 | A1 | 6/1998 |
| WO | 1998030387 | A1 | 7/1998 |
| WO | 2002084024 | A1 | 10/2002 |
| WO | 2005035871 | A2 | 4/2005 |
| WO | 2011051562 | A1 | 5/2011 |
| WO | 2017209739 | A1 | 12/2017 |
| WO | 2018144309 | A1 | 8/2018 |

* cited by examiner

TISSUE PRODUCTS COMPRISING CROSSLINKED FIBERS

BACKGROUND

In the manufacture of paper products, such as facial tissue, bath tissue, paper towels, dinner napkins, and the like, a wide variety of product properties are imparted to the final product through the use of chemical additives applied in the wet end of the tissue making process. Three of the most important attributes imparted to tissue through the use additives and processing are bulk, strength and softness. Increasing bulk allows the tissue maker to use less fiber to produce a given volume of tissue while improving the hand feel of the tissue product. Bulk increases however need to be balanced with softness and strength. Increases in bulk may result in less inter-fiber bonding, which may reduce strength to a point where the product fails in use and is unacceptable to the user. Any increase in strength, however, must also be balanced against softness, which is generally inversely related to strength.

Higher bulk can be achieved by embossing but embossing normally requires a relatively stiff sheet in order for the sheet to retain the embossing pattern. Increasing sheet stiffness negatively impacts softness. Conventional embossing also substantially reduces the strength of the sheet and may lower the strength below acceptable levels in an effort to attain suitable bulk. In terms of manufacturing economy, embossing adds a unit operation and decreases efficiency.

Another means of balancing bulk, softness and strength is to use a chemical debonding agent such as a quaternary ammonium compound containing long chain alkyl groups. The cationic quaternary ammonium entity allows for the material to be retained on the cellulose via ionic bonding to anionic groups on the cellulose fibers. The long chain alkyl groups provide softness to the tissue sheet by disrupting fiber-to-fiber hydrogen bonds in the sheet. The use of such debonding agents is broadly taught in the art. Such disruption of fiber-to-fiber bonds provides a two-fold purpose in increasing the softness of the tissue. First, the reduction in hydrogen bonding produces a reduction in tensile strength thereby reducing the stiffness of the sheet. Secondly, the debonded fibers provide a surface nap to the tissue web enhancing the "fuzziness" of the tissue sheet. This sheet fuzziness may also be created through use of creping as well, where sufficient interfiber bonds are broken at the outer tissue surface to provide a plethora of free fiber ends on the tissue surface. Both debonding and creping increase levels of lint and Slough in the product. Indeed, while softness increases, it is at the expense of an increase in lint and Slough in the tissue relative to an untreated control. It can also be shown that in a blended (non-layered) sheet the level of lint and Slough is inversely proportional to the tensile strength of the sheet. Lint and Slough can generally be defined as the tendency of the fibers in the paper web to be rubbed from the web when handled.

Other attempts to balance bulk, strength and softness have involved reacting wood pulp fibers with cellulose reactive agents, such as triazines, to alter the degree of hydrogen bonding between fibers. While this perhaps helps to give a product improved bulk and an improved surface feel at a given tensile strength, such products generally have poor tensile strength as a result of the reduced fiber-fiber bonding and exhibit higher Slough and lint at a given tensile strength. As such, such products generally are not satisfactory to the user.

Accordingly, there remains a need in the art for balancing bulk, strength and softness in a tissue product. Further, there is a need for a tissue product that balances these properties, while also providing a tissue product having lint and Slough levels that are acceptable to the user.

SUMMARY

It has now been discovered that a wet-laid tissue having good formation, bulk, softness and strength may be manufactured with crosslinked softwood fibers. The crosslinked softwood fibers, which generally have relatively low kink and curl, such as a Curl Index of about 0.30 or less and a Kink Index of about 1.50 $mm^{-1}$ or less, may be blended with conventional papermaking fibers, dispersed in water and wet-laid to form a tissue web. The resulting wet-laid tissue web has good formation, such as a Formation Index of about 20 or greater. In this manner, the inventive tissue products have formation comparable to, or better than, similar tissue products consisting entirely of conventional, non-crosslinked, papermaking fibers.

In addition to having good formation, the instant tissue products have good tensile strength and durability and may also have improved bulk. Further, in certain embodiments, the tissue products of the present invention may also be less stiff and have improved softness, compared to similar tissue products consisting entirely of conventional, non-crosslinked, papermaking fibers.

Accordingly, in one embodiment the present invention provides a method of manufacturing a wet-laid tissue product comprising the steps of dispersing a plurality of crosslinked softwood fibers having a Curl Index of about 0.30 or less and a Kink Index of about 1.50 $mm^{-1}$ or less in water to form a first fiber slurry, dispersing a plurality of conventional papermaking fibers in water to form a second fiber slurry, depositing the first and second fiber slurries on a forming fabric to form a wet tissue web, partially dewatering the wet tissue web and drying the partially dewatered tissue web. The resulting wet-laid tissue web generally has good formation and sufficient strength to withstand use. For example, the wet-laid tissue web may have a Formation Index of about 20 or greater and a Durability greater than about 30, such as from about 30 to about 50, such as from about 35 to about 50, such as from about 40 to about 50.

In other embodiments, the present invention provides a method of manufacturing a wet-laid tissue product comprising the steps of forming a first fiber slurry comprising conventional papermaking fibers, forming a second fiber slurry comprising crosslinked softwood kraft fibers having a Curl Index of about 0.30 or less and a Kink Index of about 1.50 $mm^{-1}$ or less, depositing the first and the second fiber slurries on a forming fabric to form a multi-layered tissue web, partially dewatering the multi-layered tissue web, and drying the multi-layered tissue web. In certain preferred embodiments the multi-layered web may comprise from about 30 to about 80 weight percent (wt %) conventional papermaking fibers and from about 20 to about 70 weight percent crosslinked southern softwood kraft fibers.

In other embodiments crosslinked fibers are selectively incorporated into one or more layers of a multilayered tissue web to increase bulk and reduce stiffness without a significant reduction in tensile strength. Accordingly, in one preferred embodiment the present disclosure provides a multi-layered tissue web comprising crosslinked softwood pulp fibers selectively disposed in one or more layers, wherein the tissue layer comprising crosslinked fibers is adjacent to a layer comprising non-crosslinked fiber and which is substantially free from crosslinked fiber.

Other features and aspects of the present invention are discussed in greater detail below.

DEFINITIONS

Figure 1:
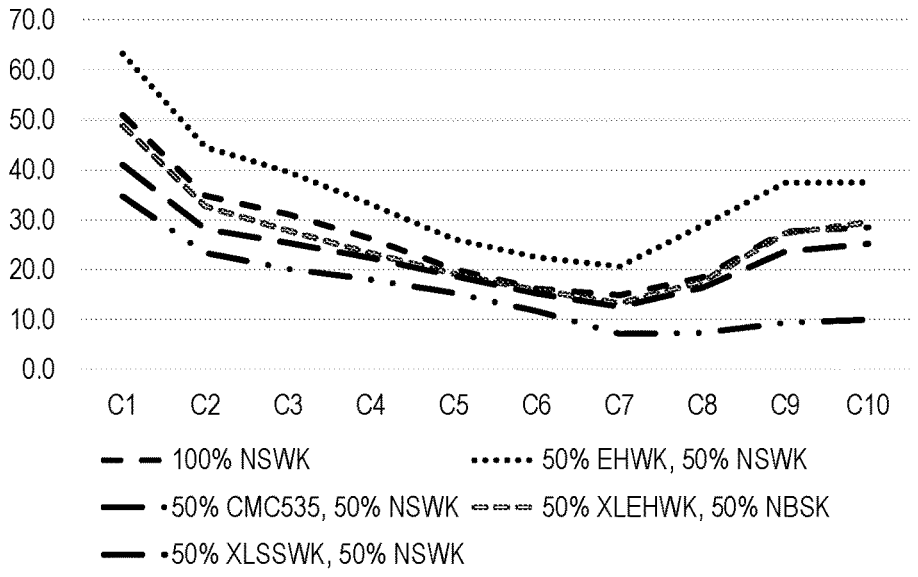
FIG. 1 illustrates the formation profile of handsheets comprising different furnish blends.

As used herein the term "crosslinked fiber" generally refers to cellulosic fibers reacted with a crosslinking agent, which is preferably a glyoxal based crosslinking reagent made from reacting a dialdehyde compound with a caustic soda, causing intrafiber crosslinking. In certain preferred embodiments crosslinked fibers useful in the present invention comprise crosslinked softwood fibers and more preferably crosslinked southern softwood kraft pulp fibers. Crosslinked fibers useful in the present invention generally have low degrees of kink and curl, such as a Curl Index of about 0.30 or less, and a Kink Index of about 2.0 $mm^{-1}$ or less.

As used herein the term "Curl Index" generally refers to the length weighed Curl Index determined using an OpTest Fiber Quality Analyzer (FQA) from OpTest Equipment, Hawkesbury, Ontario, Canada, Model No. Code LDA 96. Preferably crosslinked fibers useful in the present invention comprise crosslinked softwood kraft fibers having a Curl Index of about 0.25 or less, more preferably about 0.22 or less and still more preferably about 0.20 or less, such as from about 0.10 to about 0.25, such as from about 0.10 to about 0.20.

As used herein the term "Kink Index" generally refers to the arithmetic mean Kink Index determined using an OpTest Fiber Quality Analyzer (FQA) from OpTest Equipment, Hawkesbury, Ontario, Canada, Model No. Code LDA 96. Preferably crosslinked fibers useful in the present invention comprise crosslinked softwood kraft fibers having a Kink Index of about 2.00 $mm^{-1}$ or less, more preferably about 1.80 $mm^{-1}$ or less and still more preferably about 1.60 $mm^{-1}$ or less, such as from about 1.00 to about 2.00 $mm^{-1}$, such as from about 1.20 to about 1.60 $mm^{-1}$.

As used herein, the term "basis weight" generally refers to the bone dry weight per unit area of a tissue web, product or ply and is generally expressed as grams per square meter (gsm). Basis weight is measured as set forth in the test methods section below. Tissue products of the present invention may be produced in a wide range of basis weights, such as from about 10 to about 100 gsm and more preferably from about 15 to about 60 gsm and in particularly preferred embodiments from about 15 to about 45 gsm.

As used herein, the term "caliper" is the representative thickness of a single sheet (caliper of tissue products comprising two or more plies is the thickness of a single sheet of tissue product comprising all plies) measured as set forth in the test methods section below.

As used herein, the terms "bulk" and "sheet bulk" refer to the quotient of the caliper (μm) of a tissue web, product or ply divided by the bone dry basis weight (gsm) of the tissue web, product or ply. The resulting bulk is expressed in cubic centimeters per gram (cc/g).

As used herein, the term "TEA" generally refers to the tensile energy absorption (typically having units of g·cm/$cm^2$) of a given sample and is an output of the tensile test described in the Test Methods section below.

As used herein, the term "Durability" is the sum of a web or products geometric mean tensile energy absorption (GM TEA), geometric mean tear (GM Tear) and wet burst, divided by 10, as set forth in the equation below.

$$\text{Durability} = GM\ TEA(g\cdot\text{cm/cm2}) + GM\ \text{Tear}\ (gf) + \left(\frac{\text{Wet Burst}\ (gf)}{10}\right)$$

As used herein, the term "machine direction (MD) tensile strength" is the peak load per 3 inches of sample width when a sample is pulled to rupture in the machine direction. Similarly, the "cross-machine direction (CD) tensile strength" is the peak load per 3 inches of sample width when a sample is pulled to rupture in the cross-machine direction. The percent elongation of the sample prior to breaking is the "stretch" and may be specified according to the orientation of the sample as either "MD stretch" or "CD stretch". The MD tensile strength, CD tensile strength and stretch are measured as described in the Test Methods section.

As used herein, the terms "geometric mean tensile" and "GMT" refer to the square root of the product of the machine direction tensile strength and the cross-machine direction tensile strength of the tissue product.

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "slope" refers to the slope of the line resulting from plotting tensile versus stretch and is an output of the MTS TestWorks™ in the course of determining the tensile strength as described in the Test Methods section herein. Slope is reported in units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of kilograms (kg).

As used herein, the term "geometric mean slope" (GM Slope) generally refers to the square root of the product of machine direction slope and cross-machine direction slope. GM Slope generally is expressed in units of kilograms (kg).

As used herein, the term "Stiffness Index" refers to GM Slope (typically having units of kg), divided by GMT (typically having units of g/3").

Stiffness Index =

$$\frac{\sqrt{MD\text{ Tensile Slope (kg)} \times CD\text{ Tensile Slope (kg)}}}{GMT(\text{g}/3'')} \times 1{,}000$$

While the Stiffness Index may vary, tissue products prepared according to the present disclosure generally have a Stiffness Index less than about 25.

As used herein, the term "sheet bulk" refers to the quotient of the caliper (generally having units of μm) divided by the bone dry basis weight (generally having units of gsm). The resulting sheet bulk is expressed in cubic centimeters per gram (cc/g). Tissue products prepared according to the present invention generally have a sheet bulk greater than about 6 cc/g, more preferably greater than about 8 cc/g such as from about 6 to about 10 cc/g.

As used herein, a "tissue product" generally refers to various paper products, such as facial tissue, bath tissue, paper towels, napkins, and the like.

As used herein the term "Formation Index" refers to the C5 value output of the Paper PerFect Formation Analyzer (commercially available from OpTest Equipment Inc., Hawkesbury Ontario). The results of the formation analysis, measured in the range from about 2.6 to about 4.5 mm, are expressed as C5. The test method is described in detail in U.S. Pat. No. 6,301,373, the contents of which are incorporated herein in a manner consistent with the present disclosure.

DETAILED DESCRIPTION

The present invention relates to tissue products and webs, particularly wet-laid tissue products and webs having good formation, bulk, softness and strength and comprising crosslinked fibers. Generally, the crosslinked fibers have relatively low degrees of kink and curl and are prepared using a glyoxal based crosslinking reagent. Preferably the glyoxal based crosslinking agent is made from reacting a dialdehyde compound with a caustic soda. The resulting glyoxal based crosslinking agent may be reacted with cellulosic fibers, more particularly wood pulp fibers and still more particularly softwood wood pulp fibers. Reaction of the glyoxal based crosslinking agent with cellulosic fibers disrupts hydrogen bonding between cellulosic fibers by occupying the space between the cellulosic chains. The resulting crosslinked fiber has reduced knots and knits after defiberization and is well suited for the formation of wet-laid tissue products as described herein. Additionally, the aldehyde groups present on the glyoxal crosslinking agent serve to bridge the adjacent cellulosic chains through bonding to their hydroxyl groups, thereby increasing the resiliency of the crosslinked fibers and the porosity of the sheets formed therefrom.

Any dialdehyde compound capable of reacting with caustic soda to produce a glycolate compound able to react simultaneously with the hydroxyl groups of the cellulosic chains may be used to prepare crosslinked fibers for use in the present invention. Examples of suitable dialdehydes are aliphatic and aromatic dialdehydes. Any caustic soda capable of neutralizing glyoxal may be used. Examples of caustic soda are sodium hydroxide and potassium hydroxide. If potassium hydroxide is used with glyoxal, potassium glycolate is produced. If sodium hydroxide is used, sodium glycolate is produced.

Suitable dialdehydes include, for example, glyoxal, glutaraldehyde, 1,4-cyclohexane dicarbaldehyde, 1,3-cyclohexane dicarbaldehyde, and the mixtures and combinations thereof. Preferred dialdehydes are glyoxal, glutaraldehyde and 1,4-cyclohexane dicarbaldehyde.

The glyoxal reagent may be prepared by any suitable and convenient procedure. The caustic soda is used to raise the pH of glyoxal from about 2.5 to 5.5 to 7.5.

The reaction of the dialdehyde compound with a caustic soda may be carried out at room temperature. Preferably, the reaction is carried out at room temperature for at least about one minute and up to sixty minutes. The reaction product is generally water-soluble and may be diluted with water prior to reacting with cellulosic fibers.

Crosslinked fibers may be prepared by treating cellulose fibers in sheet or roll form with an aqueous solution of glyoxal based crosslinking agent, followed by drying to dry the fiber and cure the reagent and ensure formation of covalent bonds between hydroxyl groups of cellulose fibers and the reagent. For example, a web of cellulosic fibers in roll form may be conveyed through a treatment zone where the crosslinking agent solution is applied to one or both surfaces by conventional methods such as spraying, rolling, dipping, knife-coating or any other manner of impregnation. The treated fibers may then be dried in a dryer having a temperature from about 130° C. to about 160° C., although those skilled in the art will appreciate drying temperatures, as well as drying times, may be varied to sufficiently dry the fiber and cure the reagent.

Cellulosic fibers suitable for use in the present invention include wood fiber and more particularly wood pulp fibers. Suitable wood pulp can be obtained from any of the conventional chemical processes, such as kraft and sulfite processes. Preferred fibers are those obtained from various softwood pulps such as southern pine, white pine, Caribbean pine, western hemlock, various spruces, (e.g. sitka spruce), Douglas fir, or mixtures and combinations thereof. In other instances, the cellulosic fibers may comprise two or more of the foregoing cellulose pulp products. Particularly preferred are southern softwood kraft pulp fibers.

Generally, crosslinked fibers useful in the present invention have relatively low degrees of kink and curl. Accordingly, in certain embodiments, crosslinked fibers useful in the present invention have a Curl Index of about 0.30 or less, and more preferably about 0.25 or less, and still more preferably about 0.20 or less, such as from about 0.10 to about 0.30. In other embodiments, the crosslinked cellulosic fibers have a Kink Index less than about 2.0 $mm^{-1}$ and more preferably less than about 1.75 and still more preferably less than about 1.50, such as from about 1.0 to about 2.0 $mm^{-1}$, such as from about 1.25 to about 1.75 $mm^{-1}$. The fiber properties of one particular crosslinked fiber useful in the present invention are summarized in Table 1, below.

TABLE 1

| LWFL (mm) | Curl Index | Kink Index ($mm^{-1}$) |
|---|---|---|
| 2.296 | 0.157 | 1.55 |

Crosslinked fibers useful in the present invention are readily dispersible in water and well suited for the manufacture of wet-laid tissue products. The resulting wet-laid tissue products generally have few knits and knots and relatively good formation. This is a departure from prior art tissue products that incorporated crosslinked fibers, particularly crosslinked softwood pulp fibers. Prior art tissue products comprising crosslinked wood pulp fibers often had relatively large numbers of knits and knots and poor formation. That is not the case for the tissue products of the present invention, which generally have a Formation Index greater than about 20, about 20 to about 30, such as from about 22 to about 28.

In certain preferred embodiments crosslinked fibers useful in the present invention have a formation profile that is substantially similar to the formation profile of non-crosslinked wood pulp fibers. The term "formation profile" generally refers to a plot of formation values over a range of size components, measured using the Paper PerFect Formation (PPF) Analyzer as described in the Test Methods section below. The formation profile of handsheets comprising different furnish blends is illustrated in FIG. 1. Generally, crosslinked southern softwood pulps such as CMC535 (commercially available from International Paper, Memphis, TN) have much lower formation values across a range of size components. The difference is especially dramatic in the C9-C10 range, indicating the tendency of certain crosslinked fibers to form large flocs ranging from 18.5 to 60 mm in size.

As the instant crosslinked fibers are readily dispersible in water and form sheets having few knits or knots they are well suited to manufacturing tissue webs and products using a wide range of known techniques, such as, adhesive creping, wet creping, double creping, wet-pressing, air pressing, through-air drying, creped through-air drying, uncreped through-air drying, as well as other steps in forming the paper web. In a particularly preferred embodiment, the crosslinked fibers of the present invention are used in the manufacture of tissue webs by non-compressive dewatering and drying methods, such as through-air drying. Through-air dried tissue webs may be either creped or uncreped. Examples of suitable tissue manufacturing methods are disclosed in U.S. Pat. Nos. 5,048,589, 5,399,412, 5,129,988 and 5,494,554, all of which are incorporated herein in a manner consistent with the present disclosure. When forming multi-ply tissue products, the separate plies can be made from the same process or from different processes as desired.

Accordingly, in certain embodiments, the present invention provides a wet-laid tissue web comprising crosslinked wood pulp fibers and having a Formation Index of at least about 20, such as from about 20 to about 30, such as from about 22 to about 28. In a particularly preferred embodiment, the wet-laid tissue product comprises hardwood kraft pulp fibers and crosslinked southern softwood kraft pulp fibers having a Curl Index less than about 0.30 and Kink Index less than about 2.0 $mm^{-1}$, wherein the tissue product has a Formation Index greater than about 20.

Generally, the crosslinked fibers are incorporated in tissue webs and products in an amount sufficient to alter at least one physical property of the web or product, such as sheet bulk, tensile, stiffness, or the like. As such, the resulting tissue webs and products may comprise from about 5 to about 75 percent, by weight of the tissue product, preferably from about 10 to about 60 weight percent, more preferably from about 20 to about 50 weight percent, and still more preferably from about 25 to about 45 weight percent, crosslinked cellulosic fibers.

To form tissue webs and products, crosslinked cellulosic fibers are generally combined with conventional non-crosslinked fibers to form a homogenous tissue web or incorporated into one or more layers of a layered tissue web. The non-crosslinked fibers may generally comprise any conventional papermaking fiber, which are well known in the art. For example, non-crosslinked fibers may comprise wood pulp fibers formed by a variety of pulping processes, such as kraft pulp, sulfite pulp, thermomechanical pulp, etc. Further, the wood pulp fibers may comprise wood pulp fibers having a relatively low average fiber length. For example, the wood pulp fibers may comprise kraft pulp fibers derived from hardwood fibers, such as, but not limited to, eucalyptus, maple, birch, and aspen. In other embodiments, secondary fibers obtained from recycled materials may be used, such as fiber pulp from sources such as, for example, newsprint, reclaimed paperboard, and office waste.

The non-crosslinked fibers are generally combined with crosslinked fibers, such as by blending or layering, to produce the inventive tissue webs and products. In one embodiment the fibers are arranged in layers such that the tissue web has a first layer comprising non-crosslinked hardwood kraft fibers and a second layer comprising crosslinked softwood kraft pulp fiber. In certain embodiments, the first layer may be substantially free of crosslinked fibers. Tissue products prepared according to the present invention may comprise at least about 10 percent, by weight of the tissue product, crosslinked fibers, more preferably at least about 20 weight percent and still more preferably at least about 25 weight percent, such as from about 10 to about 50 weight percent, such as from about 15 to about 40 weight percent, such as from about 20 to about 30 weight percent.

In other embodiments the crosslinked cellulosic fibers are selectively incorporated into the middle layer of a three-layered tissue web. For example, the crosslinked cellulosic fibers may comprise crosslinked southern softwood kraft fibers (SSWK) which may be selectively incorporated in the middle layer of a three-layered tissue structure where the two outer layers comprise non-crosslinked cellulosic fibers, such as non-crosslinked eucalyptus kraft pulp (EHWK). In further embodiments it may be preferred that the two outer layers be substantially free from crosslinked cellulosic fiber.

Accordingly, in one embodiment the present disclosure provides a multi-layered tissue web comprising crosslinked fibers selectively disposed in one or more layers, wherein the tissue layer comprising crosslinked fibers is adjacent to a layer comprising non-crosslinked fiber and which is substantially free from non-crosslinked fiber. In a particularly preferred embodiment, the tissue product comprises at least one multi-layered web where non-crosslinked fibers are disposed in the outer most layers, which are substantially free from crosslinked fiber.

While the foregoing structures represent certain preferred embodiments, it should be understood that the tissue product can include any number of plies or layers and can be made from various types of conventional unreacted cellulosic fibers and crosslinked fibers. For example, the tissue webs may be incorporated into tissue products that may be either single- or multi-ply, where one or more of the plies may be formed by a multi-layered tissue web having crosslinked fibers selectively incorporated in one of its layers.

Compared to similar tissue products prepared without crosslinked fibers, tissue products prepared according to the present disclosure are generally of comparable strength (measured as GMT) yet have significantly higher sheet bulk. In other instances, tissue products comprising crosslinked fibers prepared as described herein have improved durability and bulk compared to conventional tissue products. For example, tissue products comprising crosslinked southern softwood fiber, prepared as described herein, increased bulk by at least about 20 percent. In other instances, tissue products comprising 35 weight percent crosslinked southern softwood fibers had acceptable softness and formation, and enhanced durability, such as an increase in tear strength of at least about 20 percent and an increase in tensile energy absorption (TEA) of at least about 10 percent. Surprisingly, tissue products comprising crosslinked fiber prepared as described herein had improved physical properties, such as improved bulk and durability, even when compared to tissue products comprising crosslinked eucalyptus fiber, such as those described in U.S. Pat. No. 10,385,516.

Thus, in certain embodiments the present invention provides a tissue product comprising from about 5 to about 50 weight percent, and more preferably from about 10 to about 30 weight percent crosslinked fiber, wherein the product has a basis weight from about 20 to about 50 gsm, a geometric mean tensile greater than about 750 g/3", such as from about 750 to about 1,500 g/3", a sheet bulk greater than about 10 cc/g, such as from about 10 to about 20 cc/g and more preferably from about 12 to about 20 cc/g and a C5 formation value greater than about 20, such as from about 20 to about 30.

In other embodiments the inventive tissue products may comprise about 5 to about 50 weight percent, and more preferably from about 10 to about 30 weight percent crosslinked softwood kraft pulp fibers and have a geometric mean tear strength (GM Tear) greater than about 10 gf, more preferably greater than about 12 gf and still more preferably greater than about 15 gf, such as from about 10 to about 25 gf, such as from about 12 to about 22 gf.

In still other embodiments the inventive tissue products may comprise about 5 to about 50 weight percent, and more preferably from about 10 to about 30 weight percent crosslinked softwood kraft pulp fibers and have a geometric mean slope (GM Slope) less than about 20 kg, more preferably less than about 18 kg, still more preferably less than about 15 kg, such as from about 10 to about 20 kg. The relatively low modulus may translate to tissue products having a low degree of stiffness, such as a Stiffness Index less than about 10.0, more preferably less than about 9.0 and still more preferably less than about 8.0, such as from about 5.0 to about 10.0.

The basis weight of tissue webs made in accordance with the present disclosure can vary depending upon the final product. For example, the process may be used to produce bath tissues, facial tissues, and the like. In general, the basis weight of the tissue web may vary from about 10 to about 50 gsm and more preferably from about 25 to about 45 gsm. Tissue webs may be converted into single-and multi-ply bath or facial tissue products having basis weight from about 20 to about 50 gsm and more preferably from about 25 to about 45 gsm.

In certain embodiments tissue webs produced according to the present invention may be subjected to additional processing after formation such as calendering in order to convert them into tissue products. The tissue webs of the present invention are surprisingly resilient and retain a high degree of bulk compared to similar webs prepared without crosslinked fibers. The increased resiliency allows the webs to be calendered to produce a soft tissue product without a significant decrease in bulk. According, in certain embodiments the present invention provides a tissue product having a basis weight from about 20 to about 50 gsm, and more preferably from about 25 to about 45 gsm, GMT from about 500 to about 1,000 g/3", and a sheet bulk greater than about 12 cc/g.

TEST METHODS

Basis Weight

Prior to testing, all samples are conditioned under TAPPI conditions (23±1° C. and 50±2 percent relative humidity) for a minimum of four hours. Basis weight of samples measured by selecting twelve (12) products (also referred to as sheets) of the sample and making two (2) stacks of six (6) sheets. In the event the sample consists of perforated sheets of bath or towel tissue, the perforations must be aligned on the same side when stacking the usable units. A precision cutter is used to cut each stack into exactly 10.16×10.16 cm (4.0×4.0 inch) squares. The two stacks of cut squares are combined to make a basis weight pad of twelve (12) squares thick, The basis weight pad is then weighed on a top loading balance with a minimum resolution of 0.01 grams. The top loading balance must be protected from air drafts and other disturbances using a draft shield. Weights are recorded when the readings on the top loading balance become constant. The mass of the sample (grams) per unit area (square meters) is calculated and reported as the basis weight, having units of grams per square meter (gam).

Caliper

Caliper is measured in accordance with TAPPI test methods Test Method T 580 pm-12 "Thickness (caliper) of towel, tissue, napkin and facial products." The micrometer used for carrying out caliper measurements is an Emveco 200-A Tissue Caliper Tester (Emveco, Inc., Newberg, OR). The micrometer has a load of 2 kilopascals, a pressure foot area of 2,500 square millimeters, a pressure foot diameter of 56.42 millimeters, a dwell time of three seconds and a lowering rate of 0.8 millimeters per second.

Tear

Tear testing was carried out in accordance with TAPPI test method T414 "Internal Tearing Resistance of Paper (Elmendorf-type method)" using a falling pendulum instrument such as Lorentzen & Wettre Model SE 009. Tear strength is directional, and MD and CD tear are measured independently.

More particularly, a rectangular test specimen of the sample to be tested is cut out of the tissue product or tissue basesheet such that the test specimen measures 63 mm±0.15 mm (2.5 inches±0.006 inches) in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the prescribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single ply basesheet. This is done by multiplying the single ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Tensile

Tensile testing is conducted on a tensile testing machine maintaining a constant rate of elongation and the width of each specimen tested is 3 inches. Testing is conducted under TAPPI conditions. Prior to testing samples are conditioned under TAPPI conditions (23±1° C. and 50±2 percent relative humidity) for at least 4 hours and then cutting a 3±0.05 inches (76.2±1.3 mm) wide strip in either the machine direction (MD) or cross-machine direction (CD) orientation using a JDC Precision Sample Cutter (Thwing-Albert Instrument Company, Philadelphia, PA, Model No. JDC 3-10, Serial No. 37333) or equivalent. The instrument used for measuring tensile strengths was an MTS Systems Sintech 11S, Serial No. 6233. The data acquisition software was MTS TestWorks® for Windows Ver. 3.10 (MTS Systems Corp., Research Triangle Park, NC). The load cell was selected from either a 50 Newton or 100 Newton maximum, depending on the strength of the sample being tested, such that the majority of peak load values fall between 10 to 90 percent of the load cell's full-scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength having units of grams per three inches (g/3"). Tensile energy absorbed (TEA) and slope are also calculated by the tensile tester. TEA is reported in units of $g \cdot cm/cm^2$ and slope is recorded in units of kilograms (kg). Both TEA and Slope are directionally dependent and thus MD and CD directions are measured independently.

All products were tested in their product forms without separating into individual plies. For example, a 2-ply product was tested as two plies and recorded as such. In the tensile properties of basesheets were measured, the number of plies used varied depending on the intended end use. For example, if the basesheet was intended to be used for 2-ply product, two plies of basesheet were combined and tested.

Burst Strength (Wet or Dry)

Burst Strength is measured using an EJA Burst Tester (series #50360, commercially available from Thwing-Albert Instrument Company, Philadelphia, PA). The test procedure is according to TAPPI T570 pm-00 except the test speed. The test specimen is clamped between two concentric rings whose inner diameter defines the circular area under test. A penetration assembly, the top of which is a smooth, spherical steel ball, is arranged perpendicular to and centered under the rings holding the test specimen. The penetration assembly is raised at 6 inches per minute such that the steel ball contacts and eventually penetrates the test specimen to the point of specimen rupture. The maximum force applied by the penetration assembly at the instant of specimen rupture is reported as the burst strength in grams force (gf) of the specimen.

The penetration assembly consists of a spherical penetration member which is a stainless steel ball with a diameter of 0.625±0.002 inches (15.88±0.05 mm) finished spherical to 0.00004 inches (0.001 mm). The spherical penetration member is permanently affixed to the end of a 0.375±0.010 inch (9.525±0.254 mm) solid steel rod. A 2000 gram load cell is used and 50 percent of the load range, i.e., 0-1000 grams is selected. The distance of travel of the probe is such that the upper most surface of the spherical ball reaches a distance of 1.375 inches (34.9 mm) above the plane of the sample clamped in the test. A means to secure the test specimen for testing consisting of upper and lower concentric rings of approximately 0.25 inches (6.4 mm) thick aluminum between which the sample is firmly held by pneumatic clamps operated under a filtered air source at 60 psi. The clamping rings are 3.50±0.01 inches (88.9±0.3 mm) in internal diameter and approximately 6.5 inches (165 mm) in outside diameter. The clamping surfaces of the clamping rings are coated with a commercial grade of neoprene approximately 0.0625 inches (1.6 mm) thick having a Shore hardness of 70-85 (A scale). The neoprene needs not cover the entire surface of the clamping ring but is coincident with the inner diameter, thus having an inner diameter of 3.50±0.01 inches (88.9±0.3 mm) and is 0.5 inches (12.7 mm) wide, thus having an external diameter of 4.5±0.01 inches (114±0.3 mm). For each test a total of 3 sheets of product are combined.

The sheets are stacked on top of one another in a manner such that the machine direction of the sheets is aligned. Where samples comprise multiple plies, the plies are not separated for testing. In each instance the test sample comprises three sheets of product. For example, if the product is a 2-ply tissue product, three sheets of product totaling six plies are tested. If the product is a single ply tissue product, then three sheets of product totaling three plies are tested.

Samples are conditioned under TAPPI conditions for a minimum of four hours and cut into 127×127±5 mm squares. For wet burst measurement, after conditioning the samples were wetted for testing with 0.5 mL of deionized water dispensed with an automated pipette. The wet sample is tested immediately after insulting.

The peak load (gf) and energy to peak (g-cm) are recorded and the process repeated for all remaining specimens. A minimum of five specimens are tested per sample and the peak load average of five tests is reported.

Formation

Tissue web and product formation was measured using the Paper PerFect Formation (PPF) Analyzer (OpTest Equipment Inc. Ontario, Canada). The Paper PerFect analyzer is a light-transmission formation meter and is capable of measuring the formation scale of paper ranging from 0.5 to 60 mm. The PPF analyzer measures the formation characteristics of a sample by partitioning the sample into its components as a function of scale of formation, over scale of formation range indicated above. In making the measurement, the instrument uses Fourier Transform-based power spectrum analysis in partitioning the intensity of the non-uniformity of the formation into its components as a function of the scale of formation. Normally, a 256 by 256 pixel image is extracted from the original sample and subjected to the mirroring and Fast Fourier Transform (FFT) subroutines of the machine. The machine then provides wavelength numbers which directly relate to the dimension of the local non-uniformity in the plane of the sheet. The results are then expressed as Paper PerFect Formation Values (PPF) which are relative to a "perfect paper" (having a formation value of 1000 at each component, e.g. different C size range)" and C5 value, which measures formation in the range from 2.6 to 4.5 mm.

EXAMPLES

Creped Tissue Products

A conventional wet pressed, creped tissue product was prepared using southern softwood kraft pulp fibers crosslinked with a glyoxal crosslinking agent, as described herein. The physical properties of the crosslinked fibers (XLSSWK) are summarized in Table 2, below. Table 2 also provides the physical properties of conventional fibers used to produce certain tissue products of the present example, including southern softwood kraft pulp (SSWK), northern softwood kraft pulp (NSWK) and eucalyptus kraft pulp (EHWK).

TABLE 2

| Fiber Type | WRV (g/g) | LWFL (mm) | Fiber width (μm) |
|---|---|---|---|
| XLSSWK | 0.81 | 2.22 | 37.0 |
| SSWK | 0.91 | 2.33 | 36.5 |
| NSWK | 1.06 | 2.23 | 31.0 |
| EHWK | 1.13 | 0.73 | 20.2 |

The inventive examples comprised 17.5 weight percent, 35 weight percent or 50 weight percent crosslinked fiber. A 3-layered headbox was used to prepare tissue products having two different layering structures. The first layering structure was symmetric, with 30 weight percent northern softwood kraft (NSWK) in the center layer, and two outer layers comprising eucalyptus kraft pulp (EHWK) or blends of EHWK and crosslinked fiber (XLSWK). The second layering structure was asymmetric, with 30 weight percent NSWK in the first outer layer (air side layer of the tissue web), XLSWK or EHWK in the center layer and EHWK in the second outer layer (dryer side layer of the tissue web). In certain instances, the NSWK fiber was subjected to refining or starch was added to the fiber to control strength. The layering structure of the various samples are set forth in further detail in Table 3, below.

TABLE 3

| Sample | First Outer Layer (wt %) | Center Layer (wt %) | Second Outer Layer (wt %) | Refining (Min.) | Starch (kg/ADMT) |
|---|---|---|---|---|---|
| 1 | EHWK (35) | NBSK (30) | EHWK (35) | 4 | 0 |
| 2 | EHWK (35) | NBSK (30) | EHWK (35) | 4 | 5 |
| 3 | EHWK (35) | NSWK (30) | EHWK (35) | 4 | 12 |
| 4 | EHWK (35) | XLSSWK (35) | NSWK (30) | 6 | 5 |
| 5 | EHWK (35) | XLSSWK (35) | NSWK (30) | 6 | 12 |
| 6 | EHWK (20) | XLSSWK (50) | NSWK (30) | 6 | 0 |
| 7 | EHWK (20) | XLSSWK (50) | NSWK (30) | 6 | 5 |
| 8 | EHWK (35) | NSWK (30) | EHWK (35) | 4 | 1.5 |
| 9 | EHWK (17.5) XLSWK (17.5) | NSWK (30) | EHWK (17.5) XLSWK (17.5) | 4 | 5 |
| 10 | EHWK (26) XLSWK (9) | NSWK (30) | EHWK (26) XLSWK (9) | 4 | 2.5 |

The pulp fibers from the machine chests were pumped to the headbox at a consistency of about 0.02 percent. Pulp fibers from each machine chest were sent through separate manifolds in the headbox to create a 3-layered tissue structure. The fibers were deposited onto a TissueForm V forming fabric (Voith Paper Fabrics, Appleton, WI) in an inclined fourdrenier type of former.

The wet sheet from the forming fabric, at about 10 to 20 percent consistency, was vacuum dewatered and then transferred to a Superfine Duramesh press felt (Albany International Corp., Rochester, NH). The wet tissue sheet, supported by the press felt, was passed through the nip of a pressure roll, in order to partially dewater the sheet to a consistency of about 40 percent. The wet sheet was then adhered to the Yankee dryer by spraying the creping composition (PVOH) onto the dryer surface using a spray boom situated underneath the dryer.

The tissue web had a basis weight of about 16 grams per square meter (gsm). The tissue web was subjected to calendering and converted into a two-ply tissue product. The physical properties of the 2-ply tissue product are summarized in Table 4, below. The improvements in certain physical properties achieved by the inventive tissue products are highlighted in Table 5, below.

TABLE 4

| Sample | Sheet Bulk (cc/g) | GMT (g/3") | GM Slope (kg) | GM TEA | Wet Burst (gf) | GM Tear (gf) | Durability |
|---|---|---|---|---|---|---|---|
| 1 | 9.6 | 516 | 10.0 | 4.8 | 64 | 9.0 | 26.8 |
| 2 | 8.9 | 832 | 17.8 | 7.5 | 60 | 12.3 | 31.7 |
| 3 | 9.0 | 927 | 21.4 | 8.1 | 50 | 15.0 | 33.2 |
| 4 | 11.0 | 765 | 14.1 | 8.6 | 61 | 17.7 | 39.9 |
| 5 | 10.5 | 1015 | 20.7 | 10.3 | 82 | 19.6 | 46.4 |
| 6 | 10.8 | 863 | 14.6 | 9.3 | 105 | 17.8 | 47.7 |
| 7 | 11.0 | 978 | 13.8 | 11.6 | 82 | 21.8 | 51.3 |
| 8 | 8.3 | 828 | 20.1 | 6.4 | 133 | 14.4 | 34.1 |
| 9 | 9.3 | 741 | 17.4 | 8.0 | 170 | 13.9 | 38.9 |
| 10 | 8.5 | 777 | 16.5 | 6.7 | 181 | 14.0 | 38.7 |

TABLE 5

| | Control (Sample 2) | Inventive (Sample 4) | Change |
|---|---|---|---|
| Basis Wt. (gsm) | 31.1 | 31.6 | 2% |
| Caliper (μm) | 276 | 348 | 26% |
| Bulk (cc/g) | 8.87 | 11.0 | 24% |
| GM Slope (kgf) | 10.2 | 14.1 | 38% |
| GMT (g/3") | 832 | 765 | −8% |
| GM TEA | 7.51 | 8.6 | 14% |
| GM Tear (gf) | 12.3 | 17.7 | 44% |
| Wet burst (gf) | 118 | 61 | −48% |
| Durability | 31.7 | 39.9 | 26% |

Figure 2:
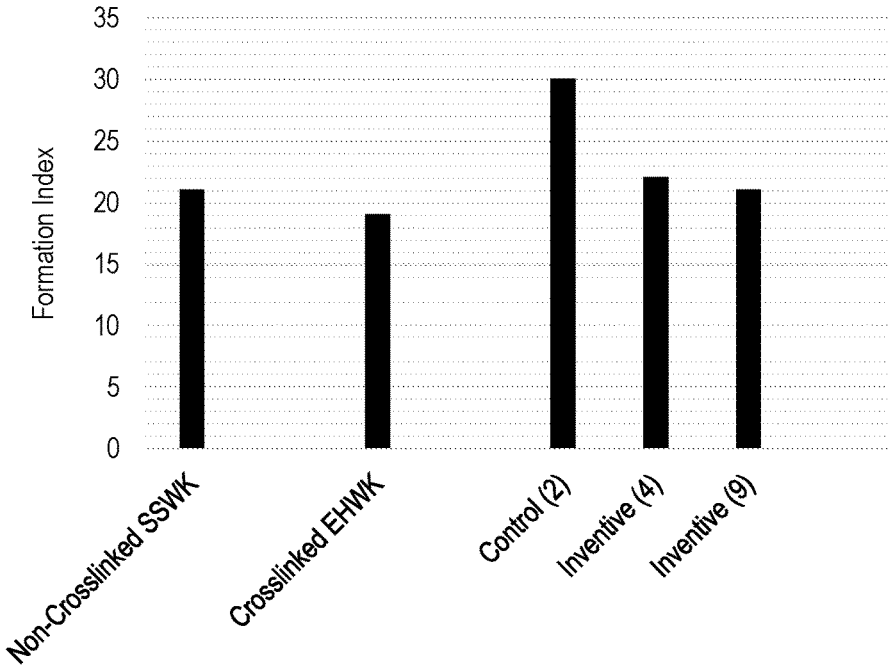
FIG. 2 illustrates the Formation Index of various tissue products.

Surprisingly the inventive tissue products had good formation despite comprising crosslinked softwood fibers. The formation was improved even compared to similarly produced tissue products comprising crosslinked hardwood kraft pulp fibers, such as those described in U.S. Pat. No. 10,385,516. The Formation Index of several tissue products of the present example are set forth in Table 6, below. The Formation Index of tissue products comprising 35 weight percent conventional SSWK (20 weight percent in first outer layer and 15 weight percent in center layer) and crosslinked EHWK (32 weight percent in the center layer) are also provided in the table below. A graph comparing the Formation Index of the various samples, summarized below, is shown as FIG. 2.

TABLE 6

| Sample | First Outer Layer (wt %) | Center Layer (wt %) | Second Outer Layer (wt %) | Formation Index |
|---|---|---|---|---|
| — | SSWK (10)<br>EHWK (25) | SSWK (15)<br>NBSK (15) | SSWK (10)<br>EHWK (25) | 21 |
| Sample 2 | XLEHWK (15) | NBSK (30) | XLEHWK (15) | 19 |
| U.S. Pat. No. 10,385,516 | EHWK (20) | | EHWK (20) | |
| 2 | EHWK (35) | NSWK (30) | EHWK (35) | 30 |
| 4 | EHWK (35) | XLSSWK (35) | NSWK (30) | 22 |
| 9 | EHWK (17.5)<br>XLSWK (17.5) | NSWK (30) | EHWK (17.5)<br>XLSWK (17.5) | 21 |

Uncreped Tissue Products

Single ply uncreped through-air dried (UCTAD) tissue webs were made generally in accordance with U.S. Pat. No. 5,607,551. The tissue webs and resulting tissue products were formed from various fiber furnishes including southern softwood kraft pulp (SSWK), crosslinked southern softwood kraft (XLSSWK) and northern softwood kraft (NSWK) and a crosslinked southern softwood kraft pulp fiber marketed as CMC535 and commercially available from International Paper Co., Memphis, TN. The XLSSWK fiber was prepared by crosslinking southern softwood kraft pulp fibers with a glyoxal crosslinking agent, as described herein.

A blended wet-laid tissue product having a target basis weight of 60 gsm and the furnish composition set forth in Table 7, was formed by depositing the fibers from a machine chest onto a TissueForm V forming fabric (Voith Paper Fabrics, Appleton, WI) in an inclined fourdrenier type of former.

TABLE 7

| Sample | Furnish Composition (wt %) | Kymene Wet Strength Additive (kg/ADMT) | Starch (kg/ADMT) |
|---|---|---|---|
| 11 | SSWK (50),<br>NSWK (50) | 3 | 6 |
| 12 | XLSSWK (50),<br>NSWK (50) | 3 | 6 |
| 13 | CMC535 (50),<br>NSWK (50) | 3 | 6 |

The formed web was non-compressively dewatered, and rush transferred to a transfer fabric traveling at a speed about 60 percent slower than the forming fabric. The transfer vacuum at the transfer to the TAD fabric was maintained at approximately 6 inches of mercury vacuum to control molding to a constant level. The web was then transferred to a throughdrying fabric, dried and wound into a parent roll. The parent rolls were then converted into 1-ply bath tissue rolls. Calendering was done with a steel-on-rubber setup. The rubber roll used in the converting process had a hardness of 40 P&J and a load of 60 PLI. The rolls were converted to a diameter of about 117 mm. Samples were conditioned and tested, the results of which are summarized in Table 8 below. The finished tissue product properties are summarized in Table 8, below.

TABLE 8

| Sample | Caliper (μm) | GMT (g/3") | GM Slope (kg) | GM TEA | Stiffness Index |
|---|---|---|---|---|---|
| 11 | 851 | 1722 | 12.13 | 26.84 | 7.04 |
| 12 | 876 | 1810 | 13.25 | 29.33 | 7.32 |
| 13 | 1026 | 436 | 1.82 | 8.29 | 4.17 |

While the crosslinked fiber CMC535 was capable of being dispersed and formed into a wet-laid tissue product, the strength was exceptionally low, approximately 75 percent less than the control, and the formation was poor, having a Formation Index of 9.0.

What is claimed is:

1. A wet-laid tissue product comprising at least one wet-laid tissue web comprising crosslinked softwood fibers and papermaking fibers and having a Formation Index of about 20 or greater, the product having a geometric mean tensile strength (GMT) greater than about 700 g/3" and a sheet bulk greater than about 10 cc/g; wherein the crosslinked softwood fibers have a Curl Index of about 0.30 or less and a Kink Index of about 1.50 $mm^{-1}$ or less.

2. The wet-laid tissue product of claim 1 wherein the crosslinked softwood fibers consist essentially of crosslinked southern softwood kraft fibers.

3. The wet-laid tissue product of claim 1 wherein the crosslinked softwood fibers consist essentially of southern softwood kraft fibers reacted with the reaction product of a dialdehyde and a caustic soda, wherein the dialdehyde is selected from the group consisting of glyoxal, glutaraldehyde, 1,4-cyclohexane dicarbaldehyde, and 1,3-cyclohexane dicarbaldehyde, and mixtures thereof.

4. The wet-laid tissue product of claim 1 wherein the at least one wet-laid tissue web is a multi-layered wet-laid tissue web having a first and a second layer and wherein the papermaking fibers are selectively disposed in the first layer and the crosslinked softwood fibers are selectively disposed in the second layer.

5. The wet-laid tissue product of claim 1 wherein the at least one wet-laid tissue web comprises from about 5 to about 70 weight percent (wt %) crosslinked softwood fibers.

6. The wet-laid tissue product of claim 1 wherein the at least one wet-laid tissue web comprises from about 20 to about 50 weight percent (wt %) crosslinked softwood fibers.

7. The wet-laid tissue product of claim 1 wherein the at least one wet-laid tissue web has a Formation Index from 20 to 30.

8. The wet-laid tissue product of claim 1 wherein the at least one wet-laid tissue web has a Formation Index from 22 to 30.

9. The wet-laid tissue product of claim 1 having a GMT from about 700 to about 2,000 g/3".

10. The wet-laid tissue product of claim 1 having a sheet bulk from about 10 to about 20 cc/g.

11. The wet-laid tissue product of claim 1 wherein the at least one wet-laid tissue web is creped.

12. The wet-laid tissue product of claim 1 wherein the at least one wet-laid tissue web is uncreped.

13. The wet-laid tissue product of claim 1 wherein at the least one wet-laid tissue web is through-air dried.

14. A single ply through-air dried tissue product comprising crosslinked softwood fibers having a Curl Index of about 0.30 or less and a Kink Index of about 1.50 $mm^{-1}$ or less and papermaking fibers and having a basis weight from about 20 to about 60 gsm, a sheet bulk of about 12 cc/g and GMT of about 700 g/3" or greater and a Formation Index of about 20 or greater.

15. The tissue product of claim 14 having a GMT from about 700 to about 1,500 g/3" and a Stiffness Index from about 4 to about 10.

16. The tissue product of claim 14 having a Formation Index from 20 to 30.

17. A method of forming a wet-laid tissue product comprising the steps of:

a. dispersing a crosslinked softwood pulp fiber having a Curl Index of about 0.30 or less and a Kink Index of about 1.5 $mm^{-1}$ or less in water to form a first fiber slurry;

b. dispersing a non-crosslinked wood pulp fiber in water to form a second fiber slurry;

c. depositing the first and the second fiber slurries in a layered arrangement on a moving belt to form a wet-laid tissue web; and d. drying the wet-laid tissue web to a yield a dried tissue web having a consistency from about 80 to about 99 percent solids and a Formation Index of at least about 20.

18. The method of claim 17 wherein crosslinked softwood fibers comprise southern softwood kraft fibers reacted with the reaction product of a dialdehyde and a caustic soda, wherein the dialdehyde is selected from the group consisting of glyoxal, glutaraldehyde, 1,4-cyclohexane dicarbaldehyde, and 1,3-cyclohexane dicarbaldehyde, and mixtures thereof.

19. The method of claim 17 wherein the dried tissue web comprises from about 5 to about 70 weight percent (wt %) crosslinked softwood fibers.

* * * * *